US006773062B2

(12) United States Patent
Illulian

(10) Patent No.: US 6,773,062 B2
(45) Date of Patent: Aug. 10, 2004

(54) SLIPCOVER BAG WITH FABRIC HANDLE

(75) Inventor: David Illulian, Beverly Hills, CA (US)

(73) Assignee: Classic Slipcovers, Inc., Vernon, CA (US)

( * ) Notice: Subject to any disclaimer, the term of this patent is extended or adjusted under 35 U.S.C. 154(b) by 0 days.

(21) Appl. No.: 10/268,125

(22) Filed: Oct. 10, 2002

(65) Prior Publication Data

US 2004/0070242 A1 Apr. 15, 2004

(51) Int. Cl.[7] ..... A47C 27/00

(52) U.S. Cl. ..... 297/228; 297/228.1; 206/457; 206/732.5; 206/769; 206/524.1; 206/581; 206/348

(58) Field of Search ..... 297/228, 228.1, 297/219.1; 206/732, 730, 769, 326, 524.1, 524.6, 581, 299, 348, 457, 287, 494

(56) References Cited

U.S. PATENT DOCUMENTS 1,922,969 A * 8/1933 MacColl
2,612,260 A * 9/1952 Schoenhut
3,109,474 A * 11/1963 Levi
4,456,122 A * 6/1984 Kalal
4,696,050 A * 9/1987 Sengewald

* cited by examiner

*Primary Examiner*—Laurie K. Cranmer
(74) *Attorney, Agent, or Firm*—Notaro & Michalos PC

(57) ABSTRACT

A slipcover bag combination includes a clear plastic bag, a folded slipcover made of a fabric having a color, pattern and texture, in a compact storage configuration in the bag and a fabric carry handle made of the same fabric as the slipcover and to an outer surface of the bag, the carry handle fabric having the same color, pattern and texture as the fabric of the slipcover.

7 Claims, 2 Drawing Sheets

SLIPCOVER BAG WITH FABRIC HANDLE

FIELD AND BACKGROUND OF THE INVENTION

The present invention relates generally to the field of product packaging, and in particular to a new and useful slipcover bag with a fabric handle made of the same material as the slipcover, the slipcover being neatly folded inside the bag which is preferably clear and preferably made of inexpensive clear vinyl with a zippered opening.

It is know to package fabric items such as blankets, sheets and slipcovers for seating furniture, in a clear plastic bag so that a consumer or buyer can see the color and pattern of the item without opening the bag. This is useful particularly to avoid infolding the item which is usually carefully and expertly folded into the smallest configuration possible in the bag.

It is also know to use such bags which have a solid rectangular shape made of clear vinyl with a zippered opening. These are higher quality bags which can be reused although the present invention in meant to include other materials and shapes for the bags and bags that are sealed shut and are meant to be torn open to release the fabric product.

The problem solved by the present invention is to provide the consumer or buyer with a sample of the fabric that can be touched and felt, without opening the bag.

The inventor's U.S. Pat. No. 6,398,301 discloses a reversible slipcover made of fabric having opposite surfaces with different colors and/or patterns. The present invention is also well suited to contain this unique type of slipcover as will be explained later in this disclosure.

SUMMARY OF THE INVENTION

It is an object of the present invention to provide a slipcover bag combination, which has a bag with a carry handle made of the same fabric as the slipcover, so that a consumer or buyer can examine the fabric color, texture and "hand," without opening the bag or unfolding the slipcover. The bag may have a zippered opening and is preferably made of clear vinyl.

For the purposes of this disclosure, the term "pattern" is used to include not only a pattern containing discernable shapes such as herringbone, strips, checkers, prints or the like, but also solid single colors.

Advantages of the invention include the fact that the purchaser of the fabric slipcover need not open the bag or unfold the slipcover to directly see and feel the fabric making up the slipcover. The color pattern and texture or feel of the fabric, sometimes referred to as the "hand" of the fabric is directly accessible to the consumer and also forms the handle for the bag. It is important that the consumer be discouraged from unfolding the slipcover since depending on the size of the sofa, love seat or easy chair to be covered, the slipcover may contain 8–10 yards of fabric. Although it is neatly folded to compactly fit within the clear bag, the folding process is performed by an expert with a large area to carefully spread out and then fold the fabric into its final storage configure. It is difficult or impossible for a consumer to reproduce the same process. As a practical matter, therefore, the slipcover can almost never be returned by the consumer to its compact configuration to fit within the bag. In the case of a retail outlet or even a buyer from a wholesale operation, to avoid loss of sale a consumer may be encouraged to open the bag and unfold the product. This leaves the retailer or wholesaler with the difficult task of folding the product again into a saleable form.

Providing the fabric handle thus eliminates the need for unfolding the slipcover. In the cases where the slipcover may include contrasting patterns, samples of both patterns can be included in the handle, for example by providing the central body of the handle of one pattern and opposite edges of the handle in the other pattern.

Another advantage of the invention is that the fabric handle automatically provides the consumer with a swatch of the same fabric as the slipcover. This swatch can be taken with the consumer to a home improvement outlet, paint store, interior designer or any other remote location where selections of paint, fabric or other item based on color must be made.

Accordingly, a further object of the invention is to provide a slipcover bag combination, which comprises a bag, a slipcover made of a fabric having at least one color, pattern and texture or feel, folded into a compact storage configuration and contained within the bag, and a fabric carry handle made of the same fabric as the slipcover and attached at at least one location to an outer surface of the bag, the carry handle fabric having the same color, pattern and texture as the fabric of the slipcover.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
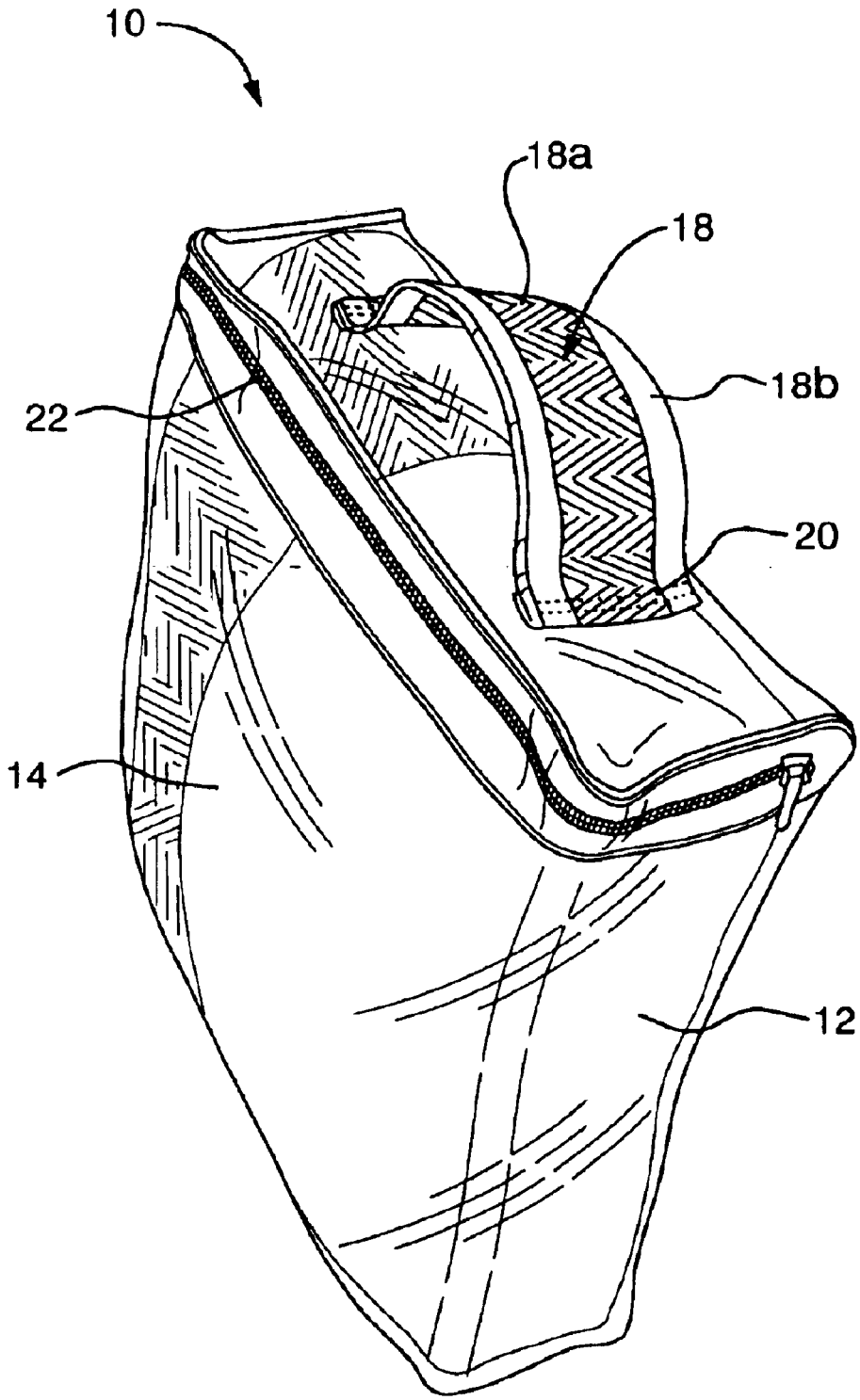
FIG. 1 is a top perspective view of the combination of the invention.

Referring now to the drawings, FIG. 1 illustrates a slipcover bag combination 10, comprising a bag 12, a folded slipcover 14 made of a fabric having at least one color, pattern and texture, in a compact storage configuration and contained within the bag, and a fabric carry handle 18 made of the same fabric as the slipcover and attached at at least one location 20, e.g. by sewing, gluing, heat fusing or other method, to an outer top surface of the bag 12.

The carry handle fabric has the same color, pattern and texture as the fabric of the slipcover so that a consumer or buyer can directly see and feel the "hand" or texture of the slipcover fabric without opening the bag.

The bag is made of clear plastic and may be an inexpensive sealed bag meant to be torn open to remove the slipcover, or a bag with a zippered opening 22 for removing the folded slipcover and for reuse as a storage container.

Figure 2:
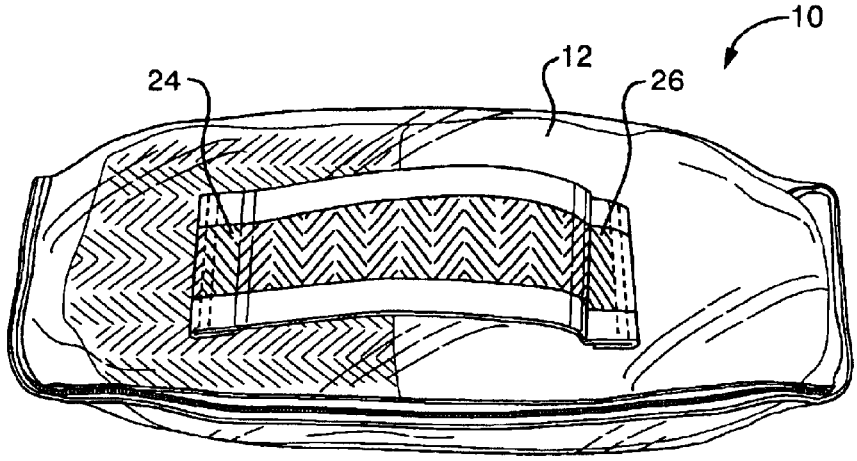
FIG. 2 is a top plan view thereof.
Figure 3:
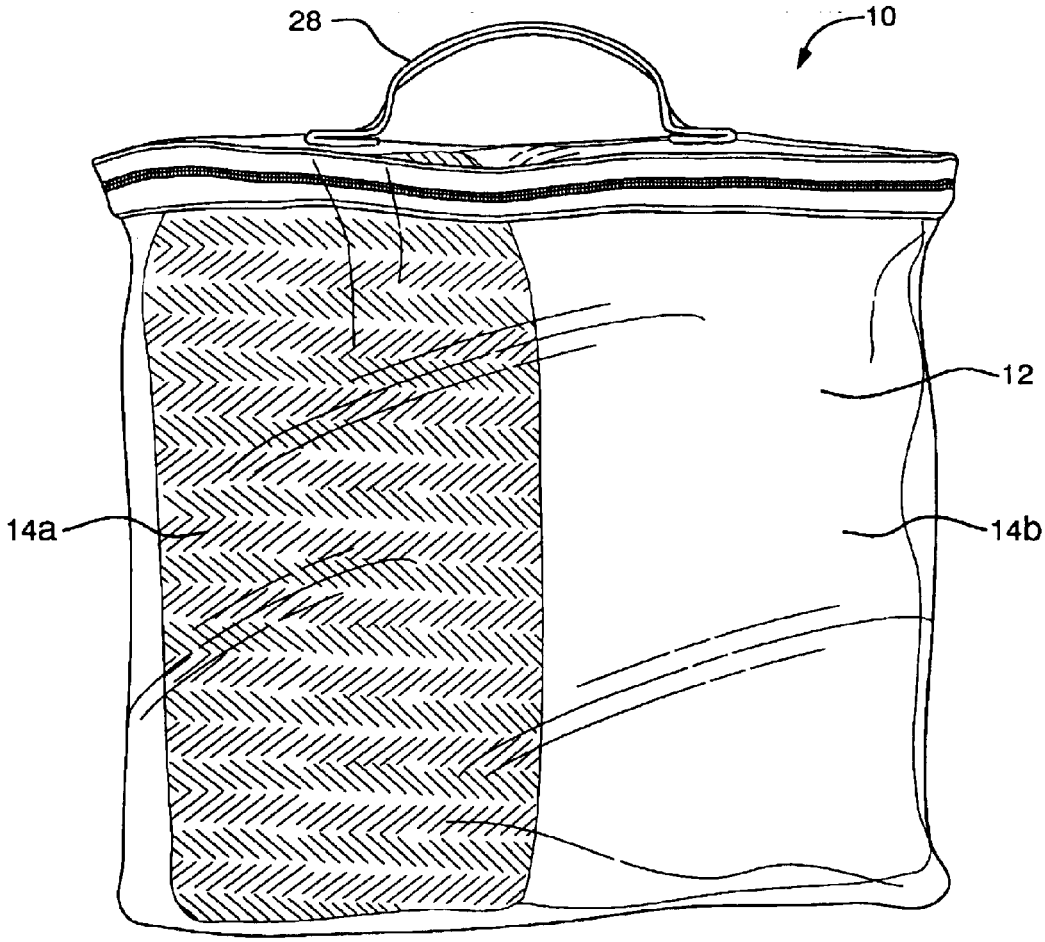
FIG. 3 is a side elevational view thereof.

The bag 12 is preferably made of clear vinyl and has a solid rectangular shape as illustrated in FIGS. 1, 2 and 3.

The handle has opposite end portions 24 and 26 shown in FIG. 2, which are both attached at spaced locations to the top side of the bag so that the bag can be carried by holding the handle between the spaced locations. These end portions lie generally flat against the top of the bag 12, and a curved loop 28 forming the handle proper is created between the spaced locations as shown in FIG. 3.

The slipcover fabric may have two or more different colors, patterns or textures, with the handle fabric also having different parts with the different colors, patterns or textures.

The slipcover may be reversible, e.g. according to U.S. Pat. No. 6,398,301, and be made of fabric having one color or pattern 14*a*, e.g. a herringbone, on its one side and another different color or pattern 14*b* on its opposite side, e.g. a solid color. The handle has the same one pattern 18*a* and other pattern 18*b* on its opposite sides. The compact folded slipcover as shown in FIG. 3, was folded so that one half of the visible slipcover in the bag shows the one pattern 14*a* on one side of the bag, and the other half of the bag shows the revered pattern 14*b* on the opposite side of the slipcover fabric. This a accomplished by a cleaver folding of the slipcover 14, which would be very difficult for the consumer or buyer to reproduce.

In order to provide the consumer or buyer with quick visual and tactile contact with a sample or swatch of the slipcover fabric in the form of the handle 18, handle has a central portion 18*a* with the one pattern facing away from the bag, and a pair of second folded over parts 18*b* at the opposite long edges of the handle, with the other pattern also facing away from the bag as shown in FIGS. 1 and 2.

While a specific embodiment of the invention has been shown and described in detail to illustrate the application of the principles of the invention, it will be understood that the invention may be embodied without departing from such principles.

What is claimed is:

1. A slipcover bag combination comprising;

a bag made of clear plastic;

a fold slipcover made of a fabric having at least one color, pattern and texture, in a compact storage configuration and contained within the bag;

the bag having a zippered opening for removing the folded slipcover; and a fabric carry handle made of the same fabric is the slipcover, the handle having opposite end portions which are both attached at spaced locations to the bag so that the bag can be carried by holding the handle between the spaced locations, the carry handle fabric having the same color, pattern and texture as the fabric of the slipcover.

2. The combination of claim 1, wherein the bag is made of clear vinyl.

3. The combination of claim 1, wherein the slipcover fabric has at least two colors, patterns or textures, the handle having a first part made of fabric having one of the two colors, patterns or textures, and another part made of a fabric having the other of the two colors, patterns or textures.

4. The combination of claim 1, wherein the slipcover is reversible, the slipcover fabric having one color, pattern or texture on its one side and another different color, pattern or texture on its opposite side, the handle having the same one and other color, pattern or texture on its opposite sides.

5. The combination of claim 4, wherein the handle has a first part with the one pattern facing away from the bag, and a second folded part with the other pattern also facing away from the bag.

6. The combination of claim 5, wherein tho first part is at a long center of the handle and the second part is at opposite long edges of the handle.

7. The combination of claim 1, wherein the bag has the shape of a solid rectangle.

* * * * *